US009707612B2

(12) United States Patent
Kohno

(10) Patent No.: US 9,707,612 B2
(45) Date of Patent: Jul. 18, 2017

(54) DIE CUSHION FORCE CONTROL METHOD AND DIE CUSHION DEVICE

(71) Applicant: AIDA ENGINEERING, LTD., Sagamihara-shi, Kanagawa (JP)

(72) Inventor: Yasuyuki Kohno, Sagamihara (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 52 days.

(21) Appl. No.: 14/572,084

(22) Filed: Dec. 16, 2014

(65) Prior Publication Data

US 2015/0185726 A1 Jul. 2, 2015

(30) Foreign Application Priority Data

Dec. 26, 2013 (JP) ..... 2013-268879

(51) Int. Cl.
*B21D 24/02* (2006.01)
*B30B 15/14* (2006.01)

(52) U.S. Cl.
CPC ..... *B21D 24/02* (2013.01); *B30B 15/14* (2013.01)

(58) Field of Classification Search
CPC ..... B21D 24/02; B21D 24/08; B21D 24/14; B21D 24/04; B30B 15/20; B30B 15/161; B30B 15/14; B30B 15/16; G05B 11/60
See application file for complete search history.

(56) References Cited

U.S. PATENT DOCUMENTS 5,100,113 A * 3/1992 Imanishi ..... B21D 24/02 267/119
7,331,208 B2 * 2/2008 Fujibayashi ..... B21D 24/02 72/20.1
7,360,391 B2 * 4/2008 Iwashita ..... B21D 24/02 72/14.8

(Continued)

FOREIGN PATENT DOCUMENTS

JP 8-1247 A 1/1996
JP 11-226794 A 8/1999

(Continued)

OTHER PUBLICATIONS

Notification of Reasons for Refusal Japanese Patent Application No. 2013-268879 dated Nov. 2, 2015 with English translation.

(Continued)

*Primary Examiner* — Moshe Wilensky
*Assistant Examiner* — Pradeep C Battula
(74) *Attorney, Agent, or Firm* — McDermott Will & Emery LLP

(57) ABSTRACT

There are provided a die cushion force control method and a die cushion device that can improve response delay of die cushion force without changing die cushion waiting position upward. In the die cushion force control method, a servo motor is driven according to a die cushion force command B previously set and the die cushion force is generated on the cushion pad. The die cushion force control method includes a step of allowing the cushion pad to wait in a predetermined die cushion waiting position at which a die cushion force action will start, and a preliminary pressurization step of outputting the die cushion force command B and preliminary applying pressure to the cushion pad before a slide of a press machine reaches the die cushion waiting position.

11 Claims, 9 Drawing Sheets

(56) References Cited

U.S. PATENT DOCUMENTS

| | | | | |
|---|---|---|---|---|
| 7,406,851 | B2 * | 8/2008 | Shiroza | B21D 24/10 72/21.5 |
| 7,461,530 | B2 * | 12/2008 | Iwashita | B21D 24/02 72/20.1 |
| 7,506,530 | B2 * | 3/2009 | Iwashita | B21D 24/02 72/20.2 |
| 7,739,894 | B2 * | 6/2010 | Suzuki | B21D 24/02 72/453.13 |
| 7,845,205 | B2 * | 12/2010 | Iwashita | B21D 24/02 72/21.1 |
| 8,037,735 | B2 * | 10/2011 | Kohno | B21D 24/02 72/351 |
| 8,127,590 | B2 * | 3/2012 | Kohno | B21D 24/02 72/453.13 |
| 8,757,056 | B2 * | 6/2014 | Kohno | B21D 24/02 100/269.01 |
| 2009/0071218 | A1 | 3/2009 | Kohno et al. | |
| 2010/0207566 | A1 | 8/2010 | Iwashita et al. | |

FOREIGN PATENT DOCUMENTS

| | | | | |
|---|---|---|---|---|
| JP | 2006-315074 | A | 11/2006 | |
| JP | 2007-301599 | A | 11/2007 | |
| JP | WO 2010058710 | A1 * | 5/2010 | B21D 24/02 |
| JP | 2012-240110 | A | 12/2012 | |

OTHER PUBLICATIONS

Extended European Search Report EP Application No. 14197629.0 dated Jul. 17, 2015.

* cited by examiner

RELATED ART

RELATED ART

RELATED ART

RELATED ART

DIE CUSHION FORCE CONTROL METHOD AND DIE CUSHION DEVICE

CROSS-REFERENCE TO RELATED APPLICATIONS

This application claims priority to Japanese Patent Application No. 2013-268879 filed Dec. 26, 2013, the subject matter of which is incorporated herein by reference in entirety.

BACKGROUND OF THE INVENTION

Field of the Invention

The present invention relates to a die cushion force control method and a die cushion device, and more specifically relates to a technique that generates predetermined die cushion force without response delay of the die cushion force.

Description of the Related Art

Conventionally, there has been proposed a servo die cushion device that drives a servo motor according to a die cushion force command previously set to generate die cushion force on a cushion pad (Japanese Patent Application Laid-Open Nos. 2006-315074, 2012-240110).

As illustrated in FIG. 7, at the time of starting die cushion force action (a press slide collides with the cushion pad with an upper die, a material, a blank holder, and a cushion pin interposed therebetween), the servo die cushion device requires a die cushion force response time a of about 0.03 second to 0.1 second (delay time required to enhance force) in order to enhance force (increase force) from a state (position control state) that load A balancing with gravity acting on a die cushion related movable mass including the material, the blank holder, the cushion pin, and the cushion pad, to predetermined die cushion force B (B: it is from several times to several tens times larger than the load A).

Further, there is a problem that impact (force) occurs due to the collision of the press slide at the time of starting the die cushion force action and thereby the die cushion force becomes larger (overshoot) or smaller (undershoot) than the die cushion force command (set force).

In order to decrease the impact (force) due to the collision of the press slide, preliminary acceleration of the cushion pad has been generally performed (Japanese Patent Application Laid-Open No. 2007-301599 and the like).

Herein, as illustrated in FIG. 8, when a preliminary acceleration time is represented by b, a die cushion force action completion (press slide) position is in a position descended from a die cushion waiting (press slide) position by moving velocity of the slide×time (a+b), depending on the total time (a+b) between the preliminary acceleration time b and the die cushion force response time a.

Due to a die cushion force response distance X, or a sum of a die cushion preliminary acceleration distance Y and the die cushion force response distance X, force to press an edge of the blank (material) is insufficient when the drawing is started (beginning of the drawing) and thus a wrinkle (drawing wrinkle) is generated in a radial direction from the edge of the material, and the drawing is continued (drawing proceeds) in a state that the wrinkle is generated, thereby, at the time of drawing, not only impairing a product shape but also causing damage (galling) on forming surfaces of dies (upper and lower) because of unevenness of the wrinkle.

At the time of stretch forming, force to press the edge of the blank (material) is also insufficient when the stretch forming is started (beginning of the stretch forming), and thus a "stretch" is lacked in a stretch part of the product. This causes a defective product, for example an outer plate of a hood of a car formed by the stretch forming, which is bowed inward by being pushed lightly by a finger. Thus, in the stretch forming, the press force at the beginning of the start of the stretch forming is especially important. It is generally thought that the servo die cushion accompanying the die cushion force response distance X and the die cushion preliminary acceleration distance Y is difficult to perform the stretch forming by the use of at least a conventional die structure (a height of an upper surface of the blank holder corresponds with a height of an upper surface of a convex die at the time of starting the stretch forming).

That is, in this interval (die cushion preliminary acceleration distance Y+die cushion force response distance X), the die cushion force action is insufficient in the drawing, and it is impossible to perform the stretch forming.

In the case where the preliminary acceleration is not performed as illustrated in FIG. 7, the die cushion force action can be obtained earlier as compared with the case where the preliminary acceleration is performed as illustrated in FIG. 8. However, the die cushion force response distance X that depends on the response time a generates. Then, insufficient responsiveness for at least the stretch forming is achieved. Further, the impact force such as overshoot or undershoot of the die cushion force due to the collision generates in this case.

Meanwhile, in the case of a pneumatic (ordinary pressure) die cushion device, a cushion pad waits in a state that it has already applied force to an upper side machine limit (stopper) and thus the die cushion force action has been completed in the die cushion force action start position. The pneumatic die cushion device has no response delay accompanied by the die cushion force action, unlike the servo die cushion device, and thus can perform the drawing and the stretch forming. However, it goes without saying that there is a problem from another point of view (for example, pressure (force) is enhanced proportionally to a slide stroke), and thus the servo die cushion device has been produced.

SUMMARY OF THE INVENTION

Problems of a servo die cushion device are caused by generation of die cushion force response distance X and further an additional distance of a preliminary acceleration distance Y for performing preliminary acceleration in order to suppress impact force (die cushion preliminary acceleration distance Y+die cushion force response distance X).

In order to solve these problems of the servo die cushion device, as illustrated in FIG. 9, there is a method for dealing with the problems in forming by previously locating a blank holder (die cushion waiting position) at a position above a die cushion force action required position by a distance corresponding to a total distance (X+Y) between the die cushion force response distance X and the die cushion preliminary acceleration distance Y (or the die cushion force response distance X).

However, this method is not applicable in many cases because of a structure of a die to be used (limit of a guide stroke). Further, an unnecessary stroke of the die cushion force causes waste of energy. In addition, there is a problem that a number of cycles (productivity) is easily decreased because a die cushion force action step is restricted by press slide velocity in many cases.

The present invention has been made in view of such circumstances, and an object thereof is to provide a die cushion force control method and a die cushion device that can improve a response delay of die cushion force without changing a die cushion waiting position upward.

In order to achieve the above object, one aspect of the present invention is a die cushion force control method of driving a servo motor according to a die cushion force command previously set to generate die cushion force on a cushion pad, the method including a step of allowing the cushion pad to wait in a predetermined die cushion waiting position at which a die cushion force action will start; and a preliminary pressurization step of outputting the die cushion force command and preliminarily applying pressure to the cushion pad before a slide of a press machine reaches the die cushion waiting position.

According to the aspect of the present invention, the cushion pad is allowed to wait in the predetermined die cushion waiting position (die cushion force action start planned position from which predetermined die cushion force acts), and the die cushion force command is output before the slide of the press machine reaches the die cushion waiting position. Thereby, pressure is preliminarily applied to the cushion pad in a die cushion force applying direction (upward). That is, the impact force is suppressed not by performing the preliminary acceleration, but by performing the preliminary pressurization to the upward direction (direction opposite to a preliminary acceleration direction) (just) before the die cushion waiting position, and the die cushion force control is started before the collision. Thereby, the die cushion force action can be obtained earlier and response delay of the die cushion force can be improved.

In a die cushion force control method according to another aspect of the present invention, it is preferable that in the preliminary pressurization step, the die cushion force command is output when the slide of the press machine reaches a preliminary pressurization start position, which is within a range of 0.1 mm or more to 60 mm or less above the die cushion waiting position.

By outputting the die cushion force command when the slide reaches the preliminary pressurization start position located above the die cushion waiting position by 0.1 mm or more, the die cushion force action can be obtained early as compared with a case where the die cushion force command is output when the slide reaches the die cushion waiting position. A reason why the upper limit is 60 mm is that the response time of the die cushion force is about 0.03 second to 0.1 second even though it depends on conditions, such as machine performance, a die to be used, a material to be formed and the like. Assuming that average response time of the die cushion force in this press machine is (0.03 second+0.1 second)/2=0.065 second, in the case where timing at which the die cushion force control is started earlier by the response time than the collision at the die cushion waiting position, is determined with the slide position, the slide position at the time of starting the die cushion force control is a value obtained by multiplying the response time (0.065 second) by slide velocity (mm/s) at the time of near the collision. Since it is thought that the slide velocity is about 800 mm/second in a fast case, and at the time, the slide position at the time of starting the die cushion force control is 0.065 second×800 mm/second=52 mm, it is set to 60 mm in order to be made to have a leeway.

In a die cushion force control method according to still another aspect of the present invention, it is preferable that in the preliminary pressurization step, the die cushion force command is output when the slide of the press machine reaches a preliminary pressurization start time point, which is a time point of 0.001 second or more to 0.1 second or less before a time point at which the slide of the press machine reaches the die cushion waiting position.

Note that 0.1 second indicates an upper limit of the die cushion force response time (response time (second) in a slowest case), and 0.001 second indicates time of control sampling time (0.001 second), which is not zero, but a minimum value at which the present invention becomes effective and for configuring digital control×one sample.

In a die cushion force control method according to yet another aspect of the present invention, it is preferable that the die cushion force control method is used in pressing that forms at least a lock bead on a material set on a blank holder with lock bead forming parts provided on an upper die set on the slide of the press machine and are provided on the blank holder supported with the cushion pad with a cushion pin interposed therebetween.

In the case of forming the lock bead on the material, damper effect generates at the time of forming the lock bead and thus can stabilize the die cushion force action. Thanks to the start of the die cushion force control before the collision, and the damper effect obtained by forming the lock bead at the time (at the time of preceding pressurization), the die cushion force action can be obtained earlier while being stabilized.

A die cushion device according to yet another aspect of the present invention, includes a die cushion force generator configured to generate die cushion force on a cushion pad by driving a servo motor, a die cushion force command unit configured to output a die cushion force command, and a die cushion force controller configured to control, according to the die cushion force command output from the die cushion force command unit, the servo motor such that the die cushion force becomes die cushion force corresponding to the die cushion force command. The die cushion force command unit outputs the die cushion force command before a slide of a press machine reaches a predetermined die cushion waiting position at which a die cushion force action will start.

A die cushion device according to yet another aspect of the present invention, includes a slide position detector configured to detect a position of the slide. The die cushion force command unit outputs the die cushion force command when a position of the slide detected by the slide position detector reaches a predetermined position above the die cushion waiting position.

In a die cushion device according to yet another aspect of the present invention, it is preferable that the predetermined position is located within a range of 0.1 mm or more to 60 mm or less.

A die cushion device according to yet another aspect of the present invention, includes a measuring instrument configured to measure time within one cycle of the slide. The die cushion force command unit outputs the die cushion force command when a time point measured with the measuring instrument reaches a predetermined time point earlier than a time point at which the slide reaches the die cushion waiting position.

A die cushion device according to yet another aspect of the present invention, it is preferable that the predetermined time point is a time point within a range of 0.001 second or more to 0.1 second or less.

A die cushion device according to yet another aspect of the present invention, includes a die cushion position controller configured to control a position of the cushion pad. The die cushion position controller allows the cushion pad to move to and wait in the die cushion waiting position.

In a die cushion device according to yet another aspect of the present invention, it is preferable that the die cushion force generator includes a hydraulic cylinder configured to support the cushion pad, a hydraulic pump/motor, a discharge port of which is connected to a pressurization chamber of the hydraulic cylinder on a cushion pressure generation side, and the servo motor, which is connected to a rotating shaft of the hydraulic pump/motor. By configuring the die cushion force generator with the hydraulic cylinder, the hydraulic pump/motor, and the servo motor, the hydraulic cylinder has damper action, and thus the impact force at the time of the collision does not easily act.

According to the present invention, the die cushion force command is output before the slide of the press machine reaches the die cushion waiting position, and thus it is possible to preliminarily apply the pressure to the cushion pad. Thereby, the die cushion force action can be obtained earlier and the response delay of the die cushion force can be improved. Further, by starting the die cushion force control before the cushion pad collides with the slide with the die interposed therebetween, the collision and the control change from the position control to the force control are performed at the different time points and, at the time (at the time of the preceding pressurization), the damper effect is obtained at the time of forming the lock bead. Therefore, the die cushion force action can be stabilized.

Figure 3:
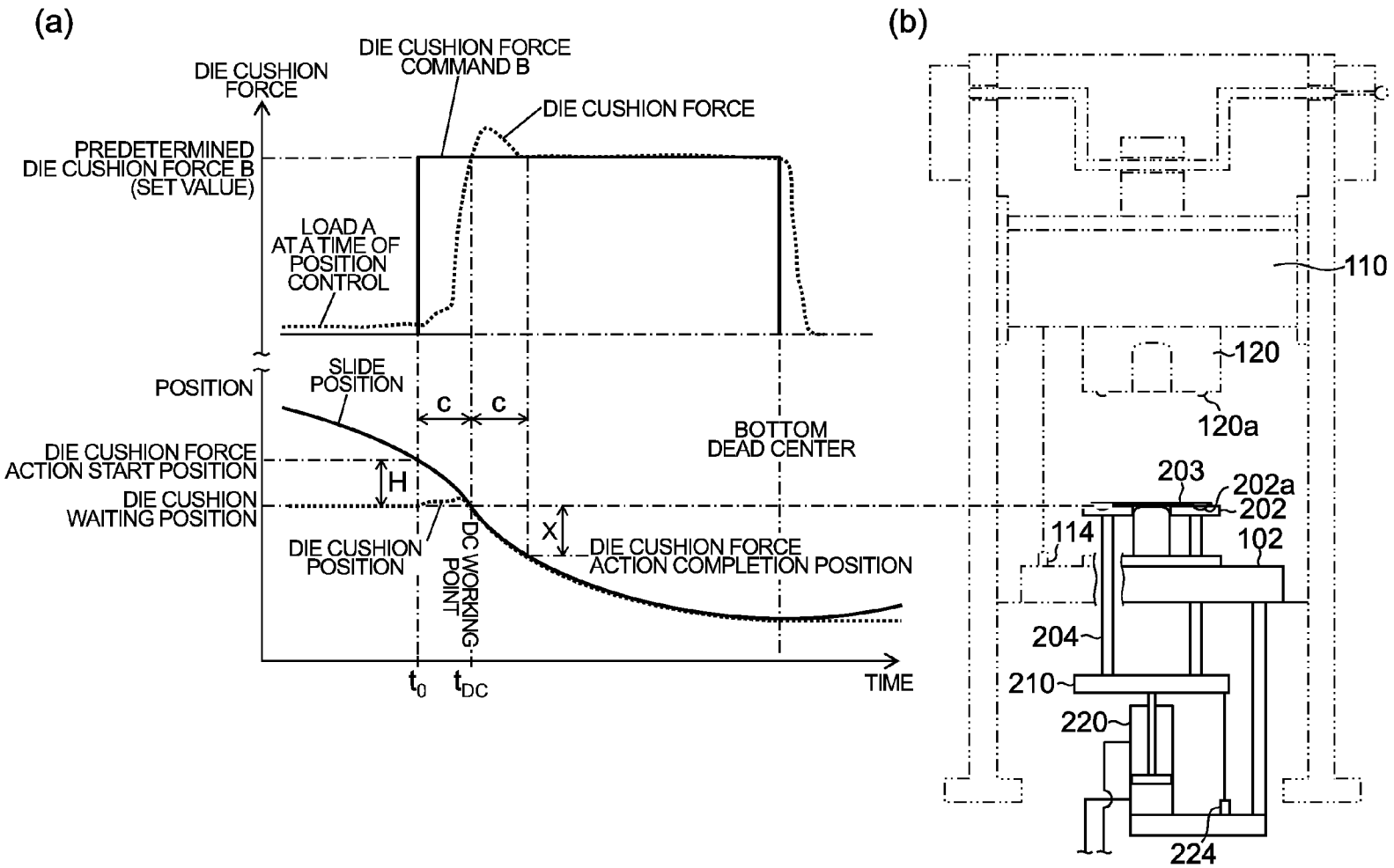
Figure 4A:
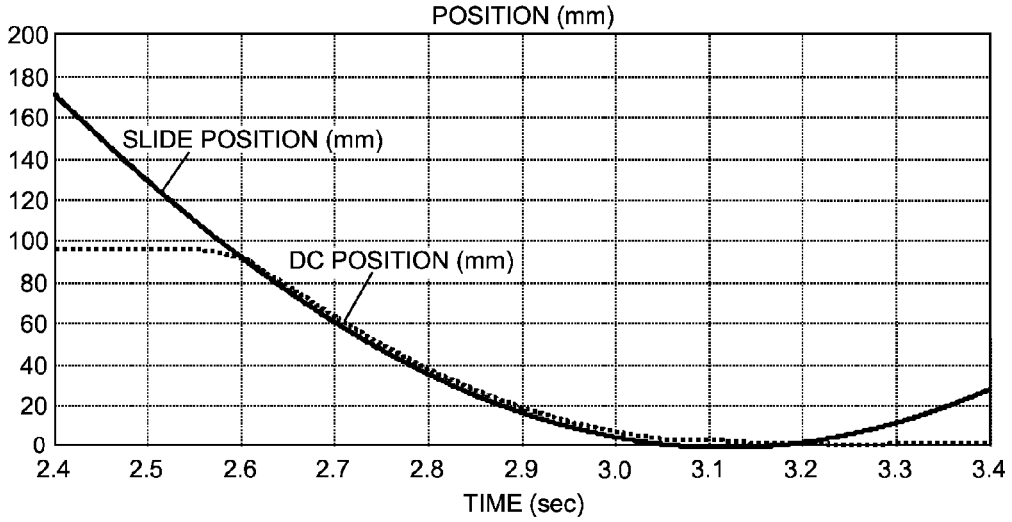
Figure 4B:
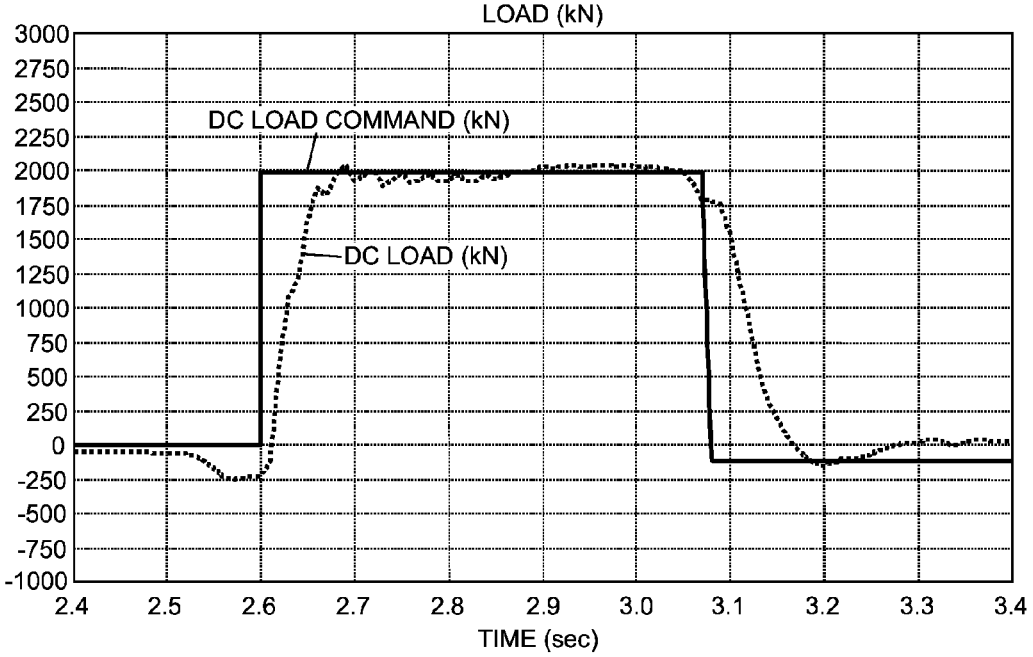
Figure 5A:
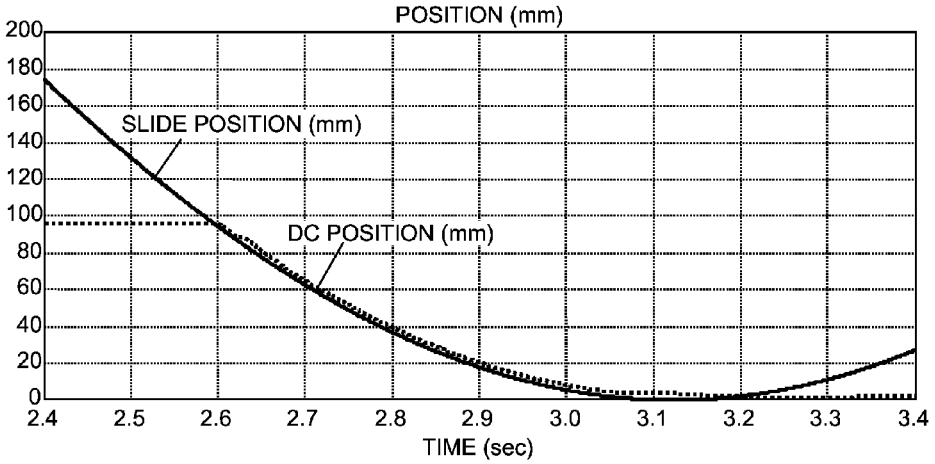
Figure 5B:
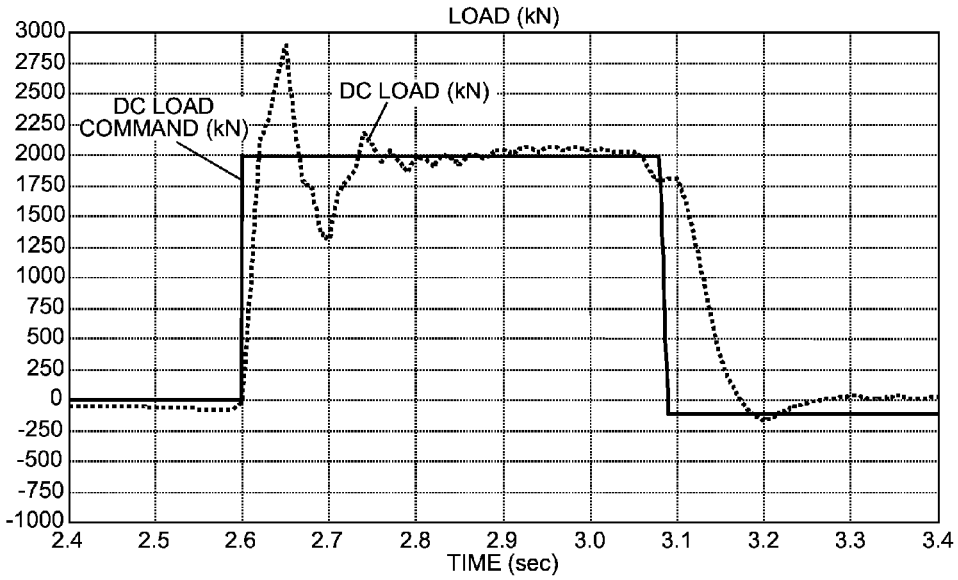
RELATED ART FIG.5B
Figure 6A:
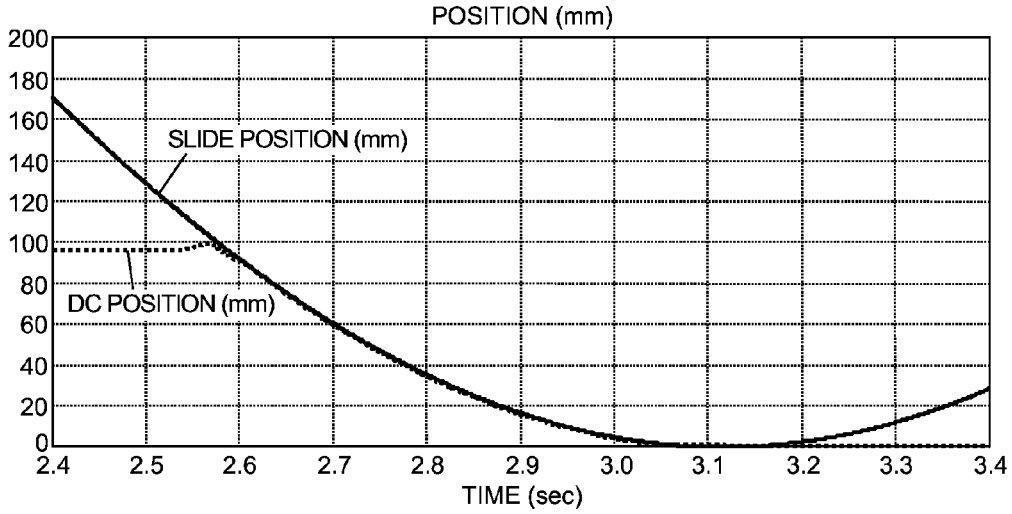
Figure 6B:
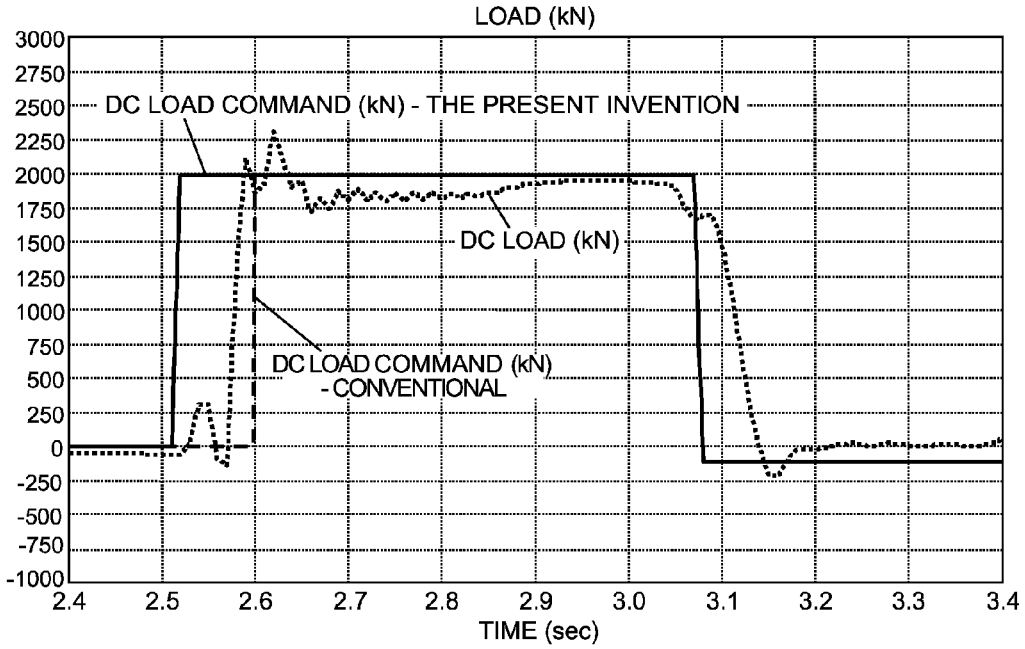
Figure 7:
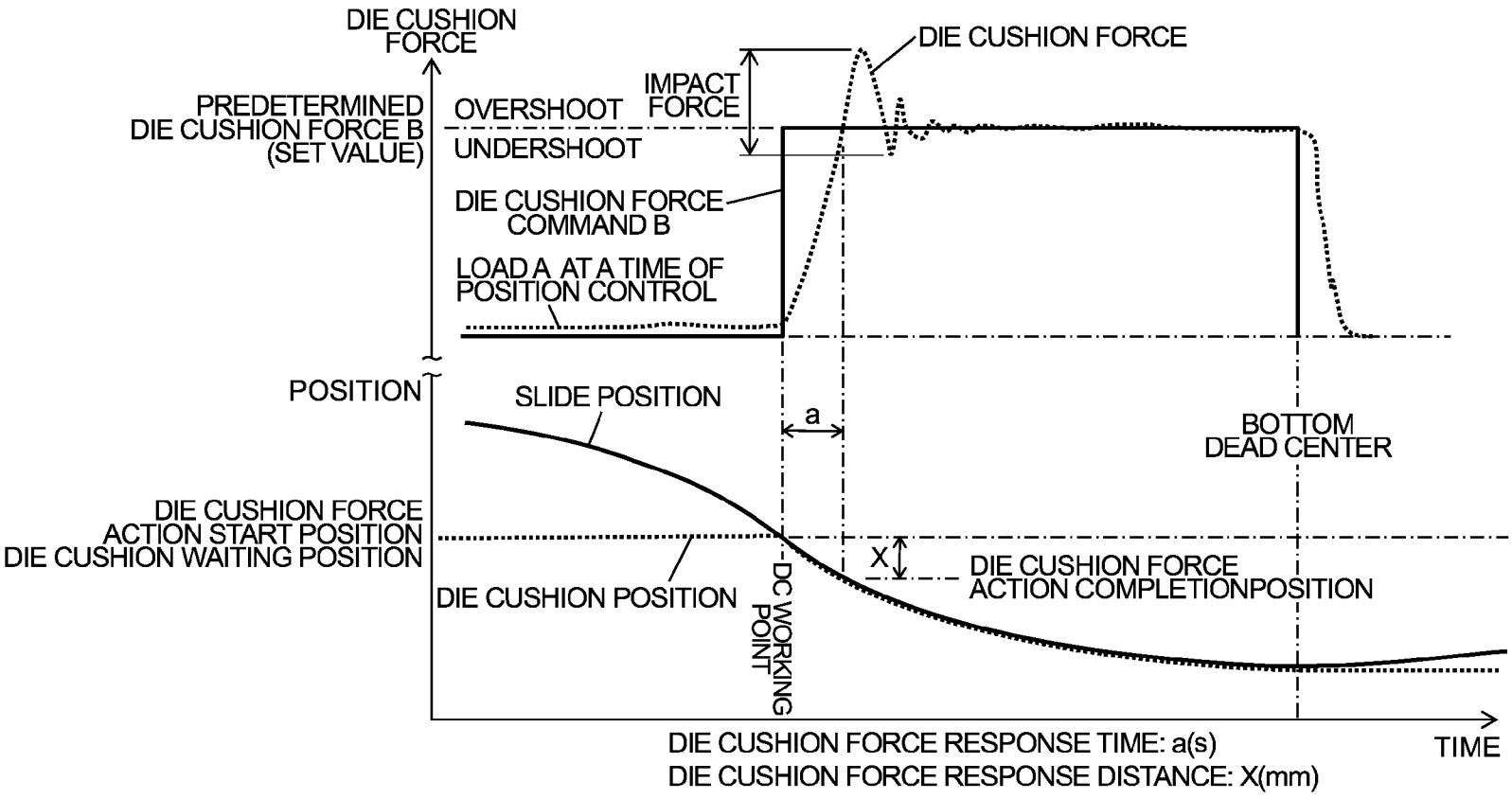
Figure 8:
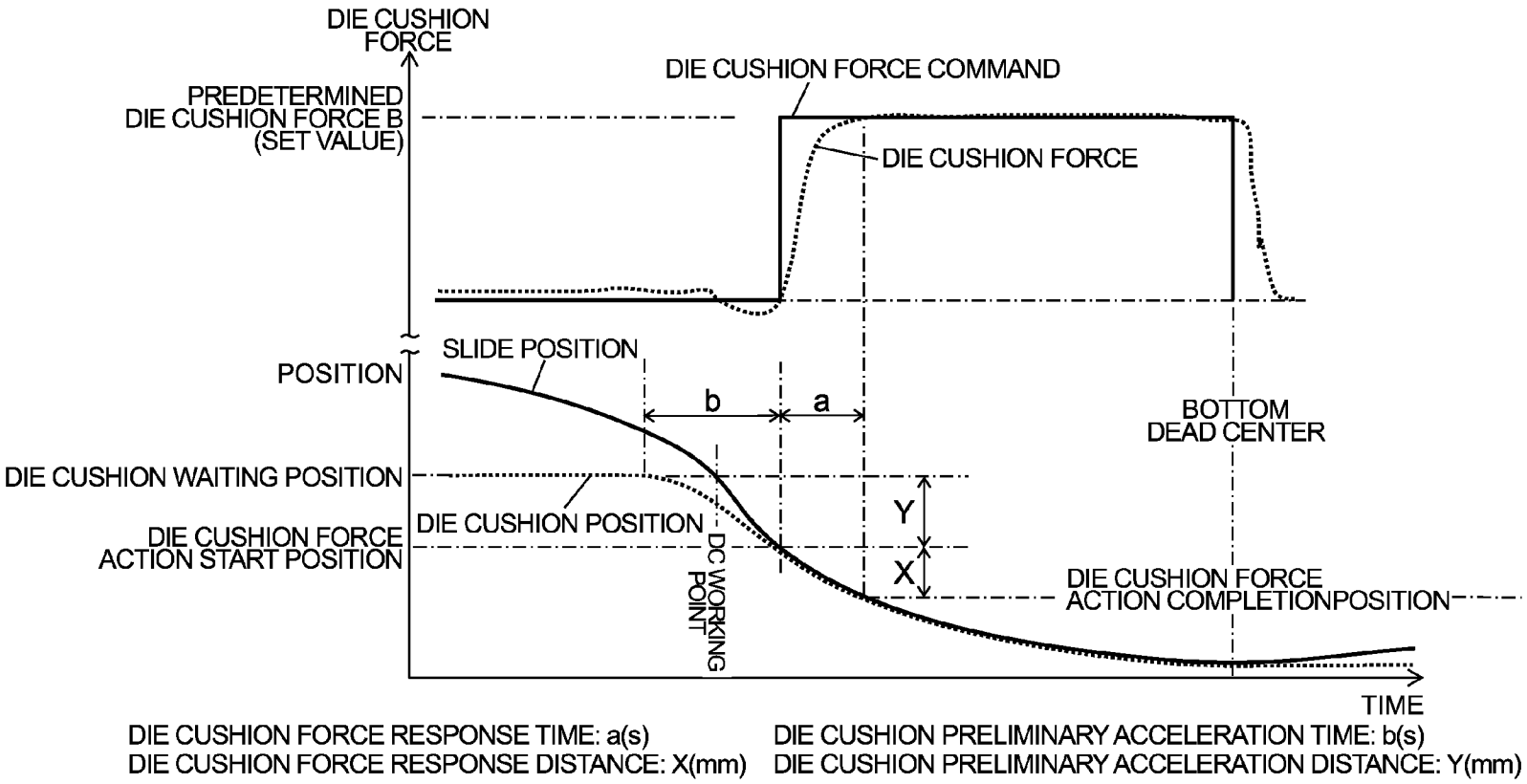
Figure 9:
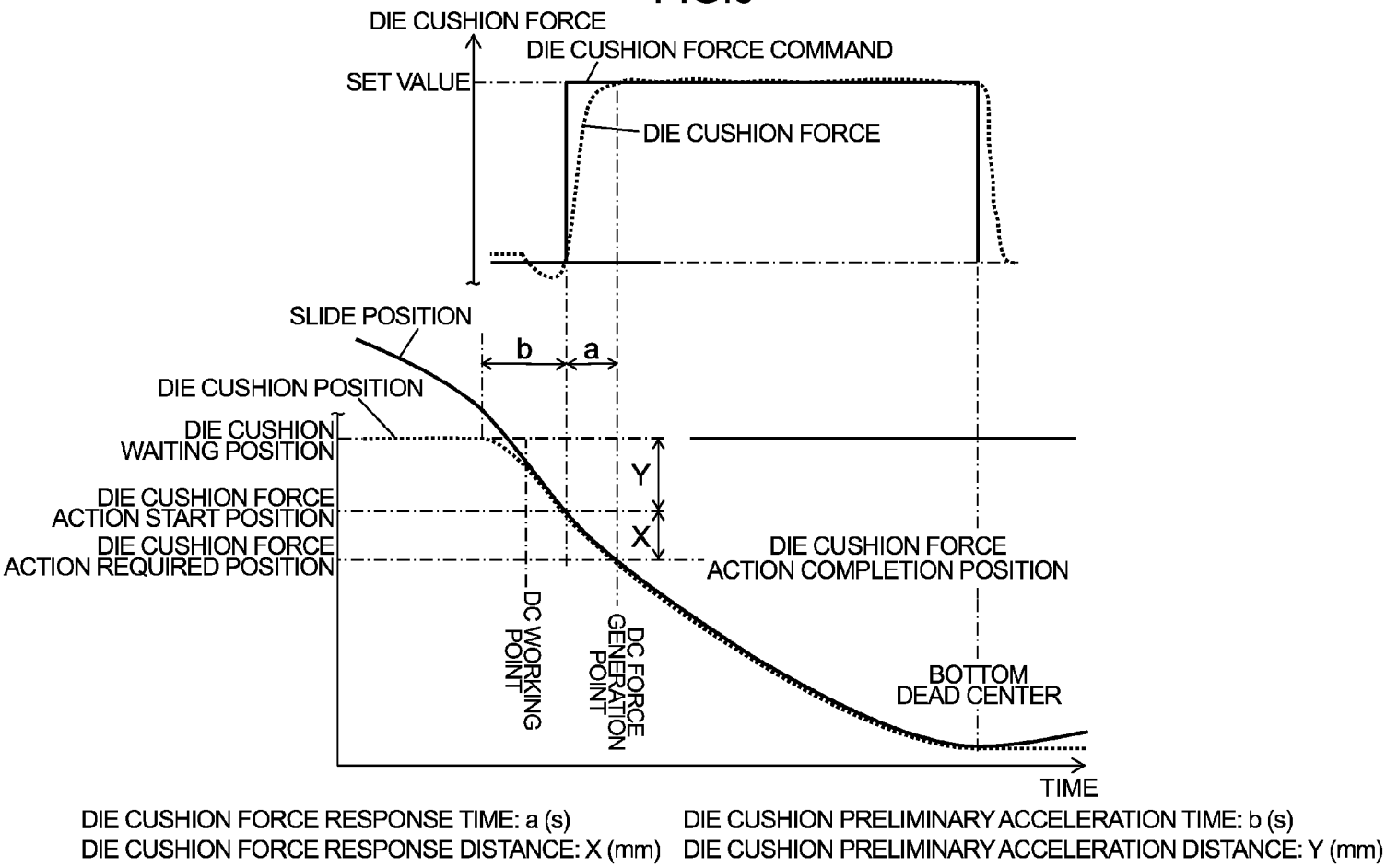

Portion (a) of FIG. 3 is a waveform diagram illustrating a die cushion force command, a die cushion force response, a slide position, and a die cushion position according to the present invention, and Portion (b) of FIG. 3 is a view illustrating a main part of the die cushion device and the like;

FIGS. 4A and 4B each are a waveform diagram illustrating a change of each physical quantity at the time of conventional die cushion force action in the case where preliminary acceleration is performed;

FIGS. 5A and 5B each are a waveform diagram illustrating a change of each physical quantity at the time of conventional die cushion force action in the case where the preliminary acceleration is not performed;

FIGS. 6A and 6B each are a waveform diagram illustrating a change of each physical quantity at the time of die cushion force action according to the present invention in the case where preliminary pressurization is performed;

FIG. 7 is a waveform diagram illustrating a change of each physical quantity at the time of the conventional die cushion force action in the case where the preliminary acceleration is not performed;

FIG. 8 is a waveform diagram illustrating a change of each physical quantity at the time of the conventional die cushion force action in the case where the preliminary acceleration is performed; and FIG. 9 is a waveform diagram illustrating a change of each physical quantity at the time of the die cushion force action in the case where a die cushion waiting position is set to a position above by a distance corresponding to a total distance between a die cushion force response distance and a die cushion preliminary acceleration distance.

DETAILED DESCRIPTION OF THE EMBODIMENTS

With reference to the attached drawings, hereinafter, description is given of preferred embodiments of a die cushion force control method and a die cushion device according to the present invention.

[Configuration of Die Cushion Device]

Figure 1:
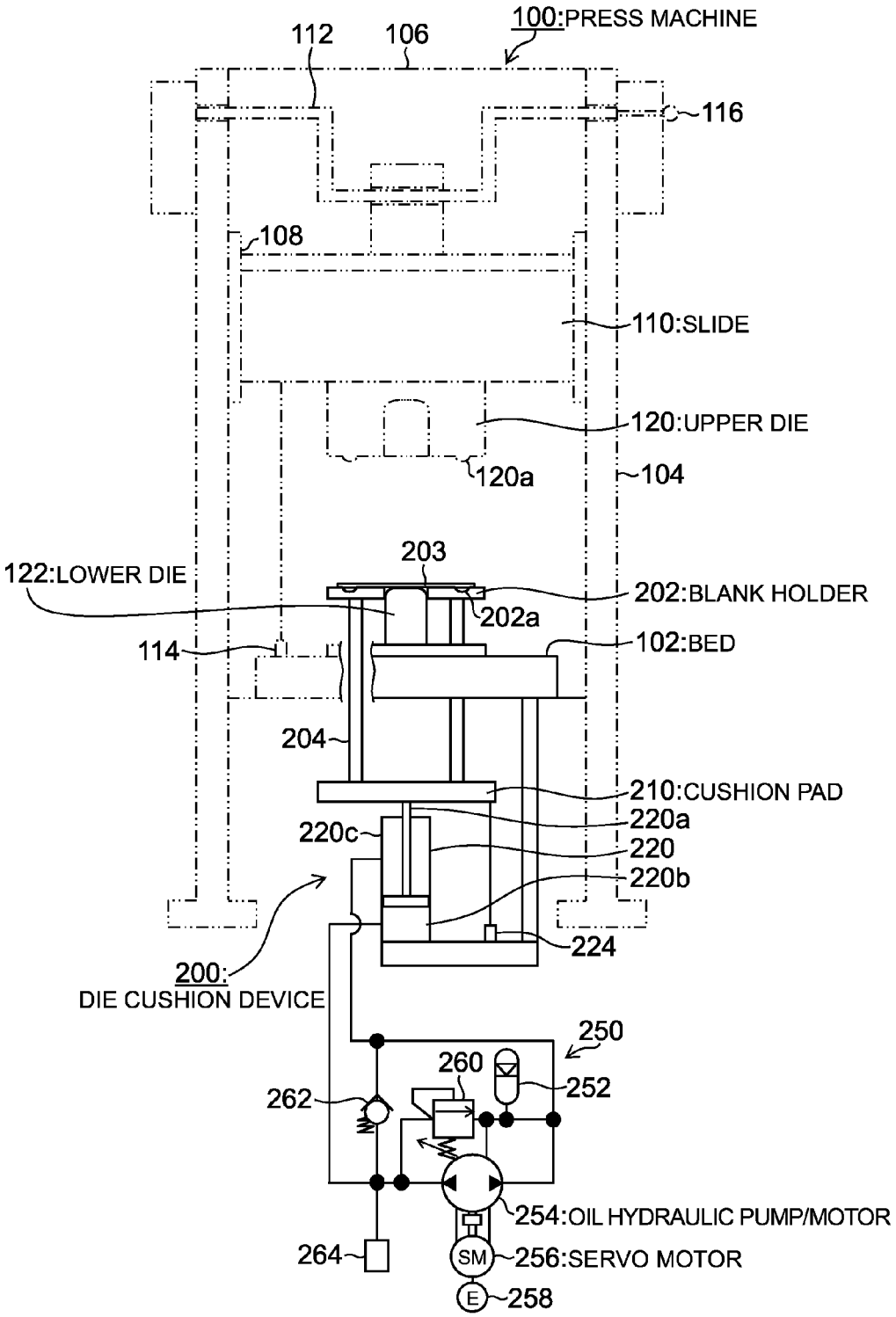
FIG. 1 is a configuration view illustrating an embodiment of a die cushion device according to the present invention.

FIG. 1 is a configuration view illustrating an embodiment of a die cushion device according to the present invention. Note that, in FIG. 1, a press machine 100 is illustrated with two-dot chain lines and a die cushion device 200 is illustrated with solid lines.

A frame of the press machine 100 illustrated in FIG. 1 includes a bed 102, a column 104, and a crown 106, and a slide 110 is guided movably in a vertical direction with a guide part 108 provided on the column 104. The slide 110 is moved in upper and lower directions of FIG. 1 with a crank mechanism including a crank shaft 112 to which rotational driving force is transmitted with a driving device not illustrated.

A slide position detector 114 that detects a position of the slide 110 is provided on the bed 102 side of the press machine 100, and a crank shaft encoder 116 that detects angular velocity and an angle of the crank shaft 112 is provided on the crank shaft 112.

An upper die 120 is mounted on the slide 110, and a lower die 122 is mounted on the bed 102 (on a bolster).

A blank holder (plate for pressing a wrinkle) 202 is disposed between the upper die 120 and the lower die 122, a lower side thereof is supported with a cushion pad 210 with a plurality of cushion pins 204 interposed therebetween, and a material 203 is set on (in contact with) an upper side thereof.

The upper die 120 of this example includes a convex lock bead forming part 120*a*, and the blank holder 202 includes a concave lock bead forming part 202*a*.

<Structure of Die Cushion Device>

The die cushion device 200 is configured mainly with the blank holder 202, the cushion pad 210 that supports the blank holder 202 with the plurality of cushion pins 204 interposed therebetween, an oil hydraulic cylinder (hydraulic cylinder) 220 that supports the cushion pad 210 and allows the cushion pad 210 to generate the die cushion force, an oil hydraulic circuit 250 that drives the oil hydraulic cylinder 220, and a die cushion control device 300 (FIG. 2) that controls the oil hydraulic circuit 250.

The oil hydraulic cylinder 220 and the oil hydraulic circuit 250 function as a cushion pad lift that allows the cushion pad 210 to move up and down, and also function as a die cushion force generator that generates the die cushion force on the cushion pad 210.

Further, there is provided a die cushion position detector 224 that detects a position of a piston rod 220*a* of the oil hydraulic cylinder 220 in an expansion and contraction direction with respect to the oil hydraulic cylinder 220 as a position of the cushion pad 210 in an up and down direction. Note that, the die cushion position detector may be provided between the bed 102 and the cushion pad 210.

Next, description is given of a configuration of the oil hydraulic circuit 250 that drives the oil hydraulic cylinder 220.

The oil hydraulic circuit 250 is configured with an accumulator 252, an oil hydraulic pump/motor (hydraulic pump/motor) 254, a servo motor 256 connected to a rotating shaft of the oil hydraulic pump/motor 254, an angular velocity detector 258 that detects angular velocity of a driving shaft of the servo motor 256 (servo motor angular velocity ω), a relief valve 260, a check valve 262, and a pressure detector 264.

The accumulator 252, to which gas pressure of low pressure is set, plays a role of a tank and supplies through the check valve 262 substantially fixed low-pressure oil to an upward side pressurization chamber (pressurization chamber on a cushion pressure generation side) 220*b* of the oil hydraulic cylinder 220 to allow it to be easily boosted at the time of controlling the die cushion force.

One of ports (discharge port) of the oil hydraulic pump/motor 254 is connected to the upward side pressurization chamber 220*b* of the oil hydraulic cylinder 220, and the other port is connected to the accumulator 252.

Note that, the relief valve 260 operates when abnormal pressure is generated (when die cushion force cannot be controlled and sudden abnormal pressure is generated) and is provided as a device that prevents damage of the oil hydraulic device. Further, a downward side pressurization chamber (pad side pressurization chamber) 220*c* of the oil hydraulic cylinder 220 is connected to the accumulator 252.

Pressure acting on the upward side pressurization chamber 220*b* of the oil hydraulic cylinder 220 is detected by the pressure detector 264, and the angular velocity of the driving shaft of the servo motor 256 is detected by the angular velocity detector 258.

[Principle of Die Cushion Force Control]

The die cushion force can be represented by product of pressure of the upward side pressurization chamber 220*b* and an area of the oil hydraulic cylinder 220, and therefore controlling the die cushion force means controlling the pressure of the upward side pressurization chamber 220*b* of the oil hydraulic cylinder 220.

Static behavior can be represented by equations (1) and (2):

$$P=\int K((v\cdot A-k1\,Q\cdot\omega)/V)dt \quad (1)$$

$$T=k2\cdot PQ/(2\pi) \quad (2)$$

where the oil hydraulic cylinder-die cushion pressure generation side sectional area is represented by a, the oil hydraulic cylinder-die cushion pressure generation side volume is represented by V, the die cushion pressure is represented by P, electric (servo) motor torque is represented by T, inertia moment of the servo motor is represented by I, a viscous resistance coefficient of the servo motor is represented by DM, friction torque of the servo motor is represented by fM, displacement volume of the oil hydraulic motor is represented by Q, force to be applied to the oil hydraulic cylinder piston rod from the slide is represented by $F_{slide}$, pad velocity generated by being pushed with the press is represented by v, an inertia mass of the oil hydraulic cylinder piston rod+the pad is represented by M, a viscous resistance coefficient of the oil hydraulic cylinder is represented by DS, friction force of the oil hydraulic cylinder is represented by fS, the angular velocity of the servo motor rotating by being pushed with pressure oil is represented by ω, a volume elasticity coefficient of operating oil is represented by K, and proportionality constants are represented by k1, k2.

Further, dynamic behavior can be represented by equations (3) and (4) in addition to the equations (1) and (2).

$$PA-F=M\cdot dv/dt+DS\cdot v+fS \quad (3)$$

$$T-k2\cdot PQ/(2\pi)=I\cdot d\omega/dt+DM\cdot\omega+fM \quad (4)$$

The above equations (1) to (4) mean that force transmitted from the slide 110 to the oil hydraulic cylinder 220 through the cushion pad 210 compresses the upward side pressurization chamber 220*b* of the oil hydraulic cylinder 220 to generate the die cushion pressure. At the same time, the die cushion pressure allows the oil hydraulic pump/motor 254 to function as the oil hydraulic motor, and when the rotating shaft torque generated in the oil hydraulic pump/motor 254 resists the driving torque of the servo motor 256, the servo motor 256 is rotated and the pressure rise can be suppressed. The die cushion pressure is determined depending on the driving torque of the servo motor 256 after all.

[Die Cushion Control Device]

Figure 2:
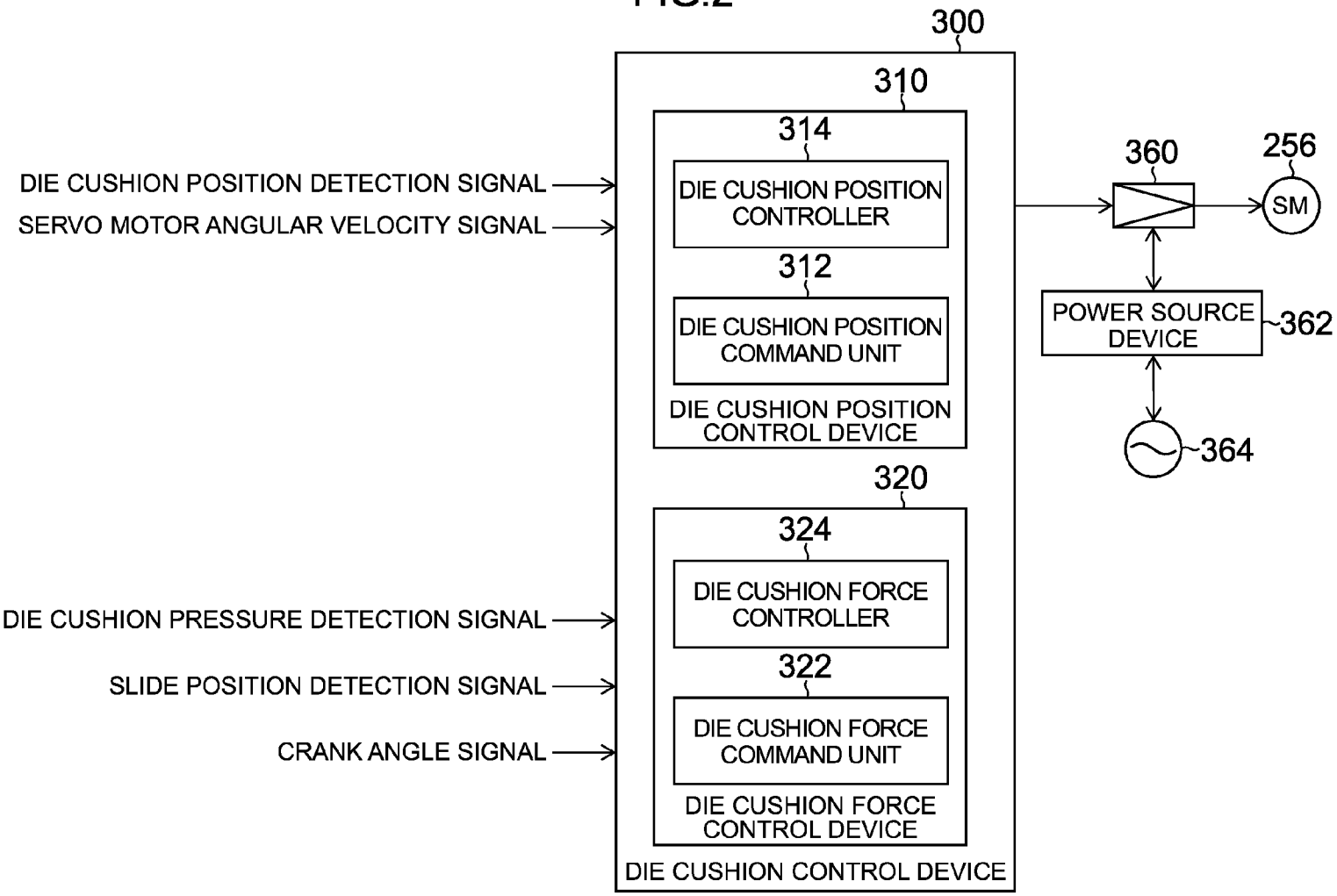
FIG. 2 is a block diagram illustrating an embodiment of a die cushion control device in the die cushion device.

FIG. 2 is a block diagram illustrating an embodiment of the die cushion control device 300 in the die cushion device 200.

The die cushion control device 300 includes a die cushion position control device 310 and a die cushion force control device 320.

A crank angle signal is applied to the die cushion control device 300 from the crank shaft encoder 116 that detects the angular velocity and the angle of the crank shaft 112. The die cushion control device 300 determines whether the slide 110 is in a non-manufacturing process area or in a manufacturing process area according to the input crank angle signal. In the case where the slide 110 is in the non-manufacturing process area, the die cushion control device 300 is switched to the die cushion position control state controlled with the die cushion position control device 310. In the case where the slide 110 is in the manufacturing process area, the die cushion control device 300 is switched to the die cushion force control state controlled with the die cushion force control device 320.

<Control of Die Cushion Position>

The die cushion position control device 310 includes a die cushion position command unit 312 and a die cushion position controller 314. A die cushion position detection signal indicating the die cushion position (cushion pad position) is applied from the die cushion position detector 224 to the die cushion position command unit 312 in order that the die cushion position command unit 312 uses the signal for generating an initial value of the position command. After the slide 110 reaches a bottom dead center and the die cushion force control is ended, the die cushion position command unit 312 outputs the die cushion position command that controls the die cushion position (position of the cushion pad 210) in order that product knockout operation is performed and the cushion pad 210 is allowed to wait in a die cushion waiting position, which is an initial position.

In the case of the die cushion position control state, the die cushion position controller 314 controls the servo motor 256 through an amplifier and PWM (pulse width modulation) controller 360 according to the die cushion position command output from the die cushion position command unit 312 and the die cushion position detection signal detected by the die cushion position detector 224 to supply the pressure oil from the oil hydraulic pump/motor 254 to the upward side pressurization chamber 220*b* of the oil hydraulic cylinder 220.

Thereby, by controlling the position of the piston rod 220*a* of the oil hydraulic cylinder 220 in the expansion and contraction direction, the position of the cushion pad 210 in the up and down direction (die cushion position) can be controlled. Note that, it is preferable that the die cushion position controller 314 controls the velocity of the servo motor 256 in order to secure dynamic stability using the angular velocity signal of the driving shaft of the servo motor 256 detected by the angular velocity detector 258, and controls the position of the cushion pad 210 in the up and down direction.

<Control of Die Cushion Force>

The die cushion force control device 320 includes a die cushion force command unit 322 and a die cushion force controller 324.

A slide position detection signal detected by the slide position detector 114 is applied to the die cushion force command unit 322 in order that the die cushion force command unit 322 outputs a die cushion force command depending on the position of the slide 110.

In this example, the die cushion force command unit 322 outputs a stepwise die cushion force command (die cushion force command B in Portion (a) of FIG. 3), which will be described later, and controls output timing or the like of the die cushion force command according to the slide position detection signal.

Note that, it is possible to provide a timer (measuring instrument) that measures time within one cycle of the slide 110 (for example, time starting from a time point at which the slide 110 detected by the crank angle signal reaches a top dead center position), so that a clocking signal indicating elapsed time after the slide 110 reaches the top dead center position can be input from the timer to the die cushion force command unit 322 and the die cushion force command unit 322 can control the output timing of the die cushion force command and the like according to the clocking signal.

In the present invention, before the position of the slide 110 reaches a die cushion force action start position, the die cushion force command unit 322 outputs the die cushion force command and preliminary pressurization is performed in order to obtain predetermined die cushion force at the die cushion force action start position. Details of the output timing at which the die cushion force command is output from the die cushion force command unit 322 will be described later.

A die cushion pressure detection signal indicating pressure of the upward side pressurization chamber 220*b* of the oil hydraulic cylinder 220, detected by the pressure detector 264, is input to the die cushion force controller 324 in order that the die cushion force controller 324 controls the die cushion force while following the die cushion force command applied from the die cushion force command unit 322. Further, the servo motor angular velocity signal indicating the angular velocity of the driving shaft of the servo motor 256 (servo motor angular velocity (ω)), detected by the angular velocity detector 258, is input to the die cushion force controller 324 as an angular velocity feedback signal for securing the dynamic stability of the die cushion force. Further, a crank angular velocity signal indicating the crank angular velocity detected by the crank shaft encoder 116 may be input to the die cushion force controller 324 in order to be used as compensation for securing the dynamic stability in the die cushion force control.

When the die cushion position (die cushion waiting position (retention)) control state is switched to the die cushion force control state, the die cushion force controller 324 performs the die cushion force control by outputting a torque command obtained by calculation using the die cushion force command, the die cushion pressure detection signal, the servo motor angular velocity signal, and the crank angular velocity signal (press velocity signal), to the servo motor 256 through the amplifier and PWM controller 360.

At the time of the die cushion force control, when the slide 110 moves down until it reaches the bottom dead center after colliding with the material 203 (and the blank holder 202) (at the time of processing), an output direction and generation velocity of the torque of the servo motor 256 are inverted. That is, the pressure oil is flown into the oil hydraulic pump/motor 254 from the upward side pressurization chamber 220*b* of the oil hydraulic cylinder 220 by power that the cushion pad 210 receives from the slide 110, so that the oil hydraulic pump/motor 254 functions as the oil hydraulic motor. With the oil hydraulic pump/motor 254, the servo motor 256 is operated to function as a generator. Electricity generated with the servo motor 256 is regenerated for an AC power source 364 through the amplifier and the PWM controller 360 and a DC power source device 362 having an electricity regeneration function.

<First Embodiment of Die Cushion Force Control Method>

In the present invention, in the die cushion device that is driven with the servo motor, the preliminary (preceding) pressurization is performed upward (die cushion force acting direction) (just) before the die cushion force control is started, so that the die cushion force action can be obtained earlier.

Thereby, the present invention is applicable to use of the stretch forming in which the predetermined die cushion force is required to act at the time of starting the stretch forming, which has been thought to be difficult when the servo die cushion device is used.

Conventionally, the preliminary acceleration has been performed in order to decrease impact (force) due to the collision at the time of the die cushion force action. In this case, the die cushion force action is obtained significantly slowly. The present invention is from an exact opposite idea to the case where the preliminary acceleration is performed.

Portion (a) of FIG. 3 is a waveform diagram illustrating the die cushion force command, the die cushion force response, the slide position, and the die cushion position according to the present invention. Further, Portion (b) of FIG. 3 is a view illustrating a main part of the die cushion device 200 and the like, and especially illustrating the blank holder 202 in a state that it waits in the predetermined die cushion waiting position.

As described above, the die cushion device 200 is switched to the die cushion position control state from the die cushion force control state when the slide 110 is in the non-manufacturing process area, and in the case of the die cushion position control state, the servo motor 256 is controlled according to the die cushion position command and the position detection value detected by die cushion position detector 224 to supply the pressure oil to the upward side pressurization chamber 220*b* of the oil hydraulic cylinder 220 from the oil hydraulic pump/motor 254. Then, before the die cushion device 200 is switched to the die cushion force control state, the position of the blank holder 202 is controlled to wait in the die cushion waiting position, which is the initial position.

Load A to be applied to the oil hydraulic cylinder 220 at the time of the die cushion position control balances with the gravity acting on the die cushion related movable mass including the material 203, the blank holder 202, the cushion pin 204, and the cushion pad 210.

When a time point at which the press slide reaches the die cushion waiting position is represented by $t_{DC}$, the die cushion force command unit 322 (FIG. 2) outputs the die cushion force command B (stepwise command) at a time point to (preliminary pressurization start time), which is earlier than the time point $t_{DC}$ by time c (second), according to the clocking signal input from the timer. Thereby, the die cushion position control state is switched to the die cushion force control state earlier than the time point $t_{DC}$ by the time c, and the die cushion force control device 320 starts the die cushion force control.

Before the slide 110 collides with the cushion pad 210 with the upper die 120, the material 203, the blank holder 202, and the cushion pin 204 interposed therebetween, the die cushion force control is started according to the die cushion force command B. Therefore, the blank holder 202 moves upward from the die cushion waiting position, the material 203 on the blank holder 202 collides with the upper die 120 descended with the slide 110 at the position above the die cushion waiting position, and the die cushion force rapidly increases.

In this example, the die cushion force reaches a set value corresponding to the die cushion force command B at the time point $t_{DC}$ at which the slide 110 reaches the die cushion waiting position. That is, a state that desired die cushion force acts can be obtained at the time point $t_{DC}$ at which the slide 110 reaches the die cushion waiting position, and thus it can offset with the die cushion force response distance X conventionally required to complete the die cushion force action (that is, the die cushion waiting position can correspond to a die cushion force action completion position).

The die cushion force command B is output before the slide 110 reaches the die cushion waiting position in this manner, so that the die cushion force response time can be zero (offset with the die cushion force response distance X) and the die cushion force action can be obtained earlier.

Further, since the die cushion force control is started before the collision, the impact force generated after the collision (overshoot, undershoot or the like) can be small as compared with that generated in the case where the die cushion control is started simultaneously with the collision.

Further, since the upper die 120 of this example includes the convex lock bead forming part 120*a*, and the blank holder 202 of this example includes the concave lock bead forming part 202*a*, a lock bead (draw bead) can be formed on the material 203 at the time of the preceding pressurization. Damper effect accompanied by forming of the lock bead can stabilize the die cushion force action.

Further, since the die cushion device 200 of this example is the servo die cushion device using the oil hydraulic cylinder and the servo motor, volume of the oil hydraulic cylinder is large and damper action strongly functions, and therefore the impact force does not easily act on the die cushion device 200 as compared with the servo die cushion device not using the oil hydraulic cylinder.

<Modification Example of First Embodiment of Die Cushion Force Control Method>

In the first embodiment of the die cushion force control method, as illustrated in FIG. 3, the die cushion force command B is output at the preliminary pressurization start time point $t_0$, which is earlier by time c than the time point $t_{DC}$ at which the press slide reaches the die cushion waiting position. The preliminary pressurization start time point $t_0$ is the time point at which the die cushion force reaches the die cushion force command B at the time point $t_{DC}$ (that is, after the time c elapses) at which the press slide reaches the die cushion waiting position when the die cushion force command B is output at the time point $t_0$. However, the preliminary pressurization start time point $t_0$ is not limited to this, and it is possible to set an appropriate time point within a range of 0.001 second or more to 0.1 second or less as long as it is a time point earlier than the time point $t_{DC}$ at which the press slide reaches the die cushion waiting position.

Herein, 0.1 second indicates an upper limit of the die cushion force response time (response time in the slowest case), and 0.001 second indicates time of control sampling time (0.001 second), which is not zero, but a minimum value at which the present invention becomes effective and for configuring digital control×one sample. In other words, though a main purpose is to make the time point of starting the die cushion force control precede for the response time as compared with the conventional collision, effect of the present invention at least functions by making the time point of starting the die cushion force control precede for a time shorter than the die cushion force response time c (one control sampling time, which is not zero=0.001 second).

Note that, the control sampling time is within a range of 0.0005 second in a short case to 0.002 second in a long case with an NC device (numerical controller) when configuring the servo die cushion device. However, it is thought that substantially 0.001 second is enough in view of the responsiveness of the machine (machine does not response in the case of less than 0.001 second).

<Second Embodiment of Die Cushion Force Control Method>

In the first embodiment of the die cushion force control method, as illustrated in FIG. 3, the die cushion force command B is output at the preliminary pressurization start time point $t_0$, which is earlier by time c than the time point $t_{DC}$ at which the press slide reaches the die cushion waiting position. However, in a second embodiment of the die cushion force control method, the die cushion force command B is output when the press slide reaches a die cushion action start position (preliminary pressurization start position corresponding to the preliminary pressurization start time point $t_0$) above the die cushion waiting position by a distance H.

That is, the slide position detection signal is input from the slide position detector 114 to the die cushion force command unit 322 (FIG. 2), and die cushion force command unit 322 detects that the slide position reaches the die cushion action start position (preliminary pressurization start position) according to the input slide position detection signal to output the die cushion force command B (see FIG. 3).

Thereby, when the press slide reaches the die cushion waiting position, the die cushion force reaches the set value corresponding to the die cushion force command B. That is, when the slide 110 reaches the die cushion waiting position, a state that desired die cushion force acts can be obtained, and thus it can offset with the die cushion force response distance X conventionally required to complete the die cushion force action (that is, the die cushion waiting position can correspond to the die cushion force action completion position).

<Modification Example of Second Embodiment of Die Cushion Force Control Method>

In the second embodiment of the die cushion force control method, the preliminary pressurization start position above the die cushion waiting position by the distance H, is a position at which the die cushion force reaches the set value corresponding to the die cushion force command B when the press slide reaches the die cushion waiting position. The preliminary pressurization start position is not limited to this and it is possible to set an appropriate position above the die cushion waiting position within a range of 0.1 mm or more to 60 mm or less.

Herein, by outputting the die cushion force command when the press slide reaches the preliminary pressurization start position above the die cushion waiting position by 0.1 mm or more, the die cushion force action can be obtained early as compared with a case where the die cushion force command is output when the press slide reaches the die cushion waiting position.

A reason why the upper limit is 60 mm is that the response time of the die cushion force is about 0.03 second to 0.1 second even though it depends on conditions, such as machine performance, a die to be used, a material to be formed and the like. Assuming that average response time of die cushion force in this press machine is (0.03 second+0.1 second)/2=0.065 second, in the case where timing at which the die cushion force control is started earlier by the response time than the collision (conventional die cushion force control start), is determined with the slide position, the slide position at the time of starting (preceding) the die cushion force control is a value obtained by multiplying the response time (0.065 second) by slide velocity (mm/s) at the time of near the collision. Since it is thought that the slide velocity is about 800 mm/second in the fast case, and at the time, the slide position (preliminary pressurization start position) at the time of starting the die cushion force control is 0.065 second×800 mm/second=52 mm, it is set to 60 mm in order to be made to have a leeway.

Example

An experiment that confirms action effect of the die cushion force was performed by operating the press machine 100 under the following conditions.

a press machine stroke: 1,100 mm crank motion: 10 spm die cushion force: 2,000 kN a die cushion stroke: 96.1 mm collision velocity (velocity at which the slide position reaches 96.1 mm): 350 mm/s

Comparative Example 1

FIGS. 4A and 4B each are a waveform diagram illustrating a change of each physical quantity at the time of the conventional die cushion force action in the case where the preliminary acceleration is performed, FIG. 4A being the waveform diagram illustrating the slide position and the die cushion position (DC position), and FIG. 4B being the waveform diagram illustrating the die cushion force command (DC load command) and the die cushion force response (DC load).

A moving distance (preliminary acceleration distance+die cushion force response distance) of the blank holder until the die cushion force corresponding to the die cushion force command was generated was 22 mm, the overshoot was 2%, and the undershoot was 5%.

In the case where the preliminary acceleration is performed, the overshoot and the undershoot are reduced, but there is a problem that the moving distance of the blank holder until the die cushion force corresponding to the die cushion force command is generated becomes longer.

Comparative Example 2

FIGS. 5A and 5B each are a waveform diagram illustrating a change of each physical quantity at the time of conventional die cushion force action in the case where the preliminary acceleration is not performed, FIG. 5A being the waveform diagram illustrating the slide position and the die cushion position, and FIG. 5B being the waveform diagram illustrating the die cushion force (load) command and the die cushion force (load) response.

A moving distance of the blank holder until the die cushion force corresponding to the die cushion force command was generated was 9 mm, the overshoot was 40%, and the undershoot was 32%.

In the case where the preliminary acceleration is not performed, the moving distance of the blank holder until the die cushion force corresponding to the die cushion force command is generated can be shorter than that in the case where the preliminary acceleration is performed, but there is a problem that the overshoot and the undershoot increase.

Comparative Example 3

FIGS. 6A and 6B each are a waveform diagram illustrating a change of each physical quantity at the time of die cushion force action according to the present invention in the case where preliminary pressurization is performed, FIG. 6A being the waveform diagram illustrating the slide position and the die cushion position, and FIG. 6B being the waveform diagram illustrating the die cushion force (load) command and the die cushion force (load) response.

A moving distance (die cushion force response distance) of the blank holder until the die cushion force corresponding to the die cushion force command was generated was 0 mm, the overshoot was 16%, and the undershoot was 12%.

In the case where the preliminary pressurization is performed, stability is slightly inferior to that in Comparative example 1 in which the preliminary acceleration is fully performed, but is generally (objectively) regarded as stable and therefore superior to that in Comparative example 2.

It should be noted that speed of the start of the die cushion force is overwhelmingly superior to that in Comparative example 1 and superior to that in Comparative example 2.

[Others]

The die cushion force generator of this embodiment includes the oil hydraulic cylinder that moves the cushion pad up and down, the oil hydraulic motor that drives the oil hydraulic cylinder, and the servo motor. The die cushion force generator is not limited to this and may include for example a screw nut mechanism that moves the cushion pad up and down, and a mechanism using a servo motor that drives the screw nut mechanism, or a rack and pinion mechanism that moves the cushion pad up and down, and a servo motor that drives the rack and pinion mechanism as long as the die cushion force generator generates the die cushion force, and the present invention can be applied to any servo die cushion devices.

Further, the case where the pressing that forms at least the lock bead on the material is performed, is described in this embodiment, but the present invention can be applied to a case where the pressing that does not form the lock bead is performed.

Further, the die cushion force command is not limited to the stepwise die cushion force command, and may be a command that changes gradually depending on the die cushion position, or changes to a taper state.

Further, the present invention is not limited to the embodiments described above, and it goes without saying that various modifications can be made without departing from the spirit of the present invention.

What is claimed is:

1. A die cushion force control method of driving a servo motor according to a die cushion force command previously set to generate die cushion force on a cushion pad, the method comprising:

a step of outputting a die cushion position command indicating a predetermined die cushion waiting position at which a die cushion force action starts, and controlling a die cushion position based on the die cushion position command to allow the cushion pad to wait in the die cushion waiting position; and a preliminary pressurization step of outputting the die cushion force command before a slide of a press machine reaches the die cushion waiting position, controlling a die cushion force based on the die cushion force command, allowing the cushion pad to move upward from the die cushion waiting position, allowing the slide to move toward the cushion pad with the cushion pad at a position above the die cushion waiting position, and preliminary applying pressure to the cushion pad until the slide reaches the die cushion waiting position.

2. The die cushion force control method according to claim 1, wherein in the preliminary pressurization step, the die cushion force command is output when the slide of the press machine reaches a preliminary pressurization start position, which is within a range of 0.1 mm or more to 60 mm or less above the die cushion waiting position.

3. The die cushion force control method according to claim 1, wherein in the preliminary pressurization step, the die cushion force command is output when the slide of the press machine reaches a preliminary pressurization start time point, which is a time point of 0.001 second or more to 0.1 second or less before a time point at which the slide of the press machine reaches the die cushion waiting position.

4. The die cushion force control method according to claim 1, wherein the method is used in pressing that forms at least a lock bead on a material set on a blank holder with lock bead forming parts that are provided on an upper die set on the slide of the press machine and are provided on the blank holder supported with the cushion pad with a cushion pin interposed therebetween.

5. A die cushion device comprising:

a die cushion force generator configured to generate die cushion force on a cushion pad by driving a servo motor;

a die cushion force command unit configured to output a die cushion force command;

a die cushion force controller configured to control, according to the die cushion force command output from the die cushion force command unit, the servo motor such that the die cushion force becomes die cushion force corresponding to the die cushion force command;

a die cushion position command unit configured to output a die cushion position command indicating a position of the cushion pad; and a die cushion position controller configured to control the position of the cushion pad based on the die cushion position command output from the die cushion position command unit, wherein the die cushion position command unit outputs a die cushion position command indicating a predetermined die cushion waiting position at which a die cushion force action starts before the die cushion position controller starts controlling the die cushion force, and wherein the die cushion force command unit outputs the die cushion force command before a slide of a press machine reaches the die cushion waiting position to allow the cushion pad to move upward from the die cushion waiting position and allow the slide to move toward the cushion pad with the cushion pad at a position above the die cushion waiting position.

6. The die cushion device according to claim 5, further comprising a slide position detector configured to detect a position of the slide, wherein the die cushion force command unit outputs the die cushion force command when a position of the slide detected by the slide position detector reaches a predetermined position above the die cushion waiting position.

7. The die cushion device according to claim 6, wherein the predetermined position is located within a range of 0.1 mm or more to 60 mm or less.

8. The die cushion device according to claim 5, further comprising a measuring instrument configured to measure time within one cycle of the slide, wherein the die cushion force command unit outputs the die cushion force command when a time point measured with the measuring instrument reaches a predetermined time point earlier than a time point at which the slide reaches the die cushion waiting position.

9. The die cushion device according to claim 8, wherein the predetermined time point is a time point within a range of 0.001 second or more to 0.1 second or less.

10. The die cushion device according to claim 5, wherein the die cushion position controller allows the cushion pad to move to and wait in the die cushion waiting position.

11. The die cushion device according to claim 5, wherein the die cushion force generator includes a hydraulic cylinder configured to support the cushion pad, a hydraulic pump/motor, a discharge port of which is connected to a pressurization chamber of the hydraulic cylinder on a cushion pressure generation side, and the servo motor connected to a rotating shaft of the hydraulic pump/motor.

* * * * *